US010043510B2

(12) United States Patent
Zelenkov

(10) Patent No.: US 10,043,510 B2
(45) Date of Patent: Aug. 7, 2018

(54) METHOD AND SYSTEM FOR AUTOMATIC DETERMINATION OF STRESS POSITION IN WORD FORMS

(71) Applicant: YANDEX EUROPE AG, Lucerne (CH)

(72) Inventor: Yury Grigorievich Zelenkov, Moscow region (RU)

(73) Assignee: Yandex Europe AG, Lucerne (CH)

( * ) Notice: Subject to any disclaimer, the term of this patent is extended or adjusted under 35 U.S.C. 154(b) by 27 days.

(21) Appl. No.: 15/366,133

(22) Filed: Dec. 1, 2016

(65) Prior Publication Data

US 2017/0185584 A1 Jun. 29, 2017

(30) Foreign Application Priority Data

Dec. 28, 2015 (RU) ..... 2015156411

(51) Int. Cl.
*G10L 13/08* (2013.01)
*G10L 13/10* (2013.01)

(52) U.S. Cl.
CPC ..... *G10L 13/10* (2013.01)

(58) Field of Classification Search
CPC ..... G10L 13/08; G10L 13/10; G06F 17/2755
USPC ..... 704/1, 8, 9, 10, 258, 260, 266
See application file for complete search history.

(56) References Cited

U.S. PATENT DOCUMENTS 5,651,095 A * 7/1997 Ogden ..... G10L 13/10 704/260
6,308,149 B1 * 10/2001 Gaussier ..... G06F 17/2755 704/9
6,411,932 B1 * 6/2002 Molnar ..... G09B 19/04 704/260
7,200,558 B2 * 4/2007 Kato ..... G10L 13/10 704/260
7,356,468 B2 * 4/2008 Webster ..... G10L 13/10 704/258
8,027,834 B2 * 9/2011 Hancock ..... G10L 13/04 704/258

(Continued)

OTHER PUBLICATIONS

Zhang et al., Learning English Stress Rules: Using a Machine Learning Approach, Pacific Association for Computational Linguistics, 1999, pp. 1-15.

(Continued)

*Primary Examiner* — Martin Lerner
(74) *Attorney, Agent, or Firm* — BCF LLP

(57) ABSTRACT

A method and a computing device for building a reference system for determining a stress position of a new word form, the method comprising: sorting, in a reverse lexicographic order, a plurality of word forms being marked with a particular stress position; clustering the plurality of sorted word forms into a plurality of clusters, comprises a plurality of terminal clusters, each terminal cluster comprising word forms having both: (i) a same ending being a terminal common ending, and (ii) a same stress position, combination of the terminal common ending and said same stress position being unique; building, using the plurality of terminal clusters, the reference system having a reference to at least one terminal cluster of the plurality of terminal clusters, the at least one terminal cluster comprising an indication of the particular stress position proper to word forms which are included in that respective terminal cluster.

20 Claims, 4 Drawing Sheets

(56) References Cited

U.S. PATENT DOCUMENTS

| | | | | |
|---|---|---|---|---|
| 8,712,776 | B2 * | 4/2014 | Bellegarda | G10L 13/08 704/258 |
| 8,930,192 | B1 * | 1/2015 | Meisel | G10L 13/08 704/260 |
| 9,886,432 | B2 * | 2/2018 | Bellegarda | G06F 17/276 |
| 2002/0128841 | A1 * | 9/2002 | Kibre | G10L 13/10 704/260 |
| 2006/0155544 | A1 * | 7/2006 | Chu | G10L 13/08 704/267 |
| 2012/0330567 | A1 * | 12/2012 | Bauer | G06F 19/22 702/20 |
| 2015/0170637 | A1 * | 6/2015 | Kim | G10L 13/10 704/258 |
| 2017/0358293 | A1 * | 12/2017 | Chua | G10L 13/10 |

OTHER PUBLICATIONS

Arciuli et al., Learning to assign lexical stress during reading aloud: Corpus, behavioural, and computational investigations, Faculty of Health Sciences, University of Sydney, Australia, Department of Psychology, Lancaster University, UK, Department of Psychology, University of York, UK pp. 1-68.

Affix from Wikipedia, the free encyclopedia, pp. 1-5, https://en.wikipedia.org/wiki/Affix, Retrieved on Oct. 27, 2016.

Chitoran et al., Using a Machine Learning Model to Assess the Complexity of Stress Systems, pp. 331-336, Proceedings LREC, May 2014.

Gillis et al., 'Lazy Learning': A Comparison of Natural and Machine Learning of Word Stress, Research Grant of the Fund for Joint Basic Research (FKFO 2.0101.94) of the Fund for Scientific Research (FWO) and by a VNC Grant 49 pages.

Monaghan et al., Running Head: Cross-linguistic analyses of stress assignment, Cross-linguistic evidence for probabilistic orthographic cues to lexical stress, Jan. 2013, pp. 1-30.

Zhang et al., Learning English Pronunciation Rules : A Machine Learning Approach, Natural Sciences and Engineering Research Council of Canada/ Institute for Robotics and Intelligent Systems/ University of Regina, 12 pages.

* cited by examiner

METHOD AND SYSTEM FOR AUTOMATIC DETERMINATION OF STRESS POSITION IN WORD FORMS

CROSS-REFERENCE

The present application claims priority to Russian Patent Application No. 2015156411, filed Dec. 28, 2015, entitled "METHOD AND SYSTEM FOR AUTOMATIC DETERMINATION OF STRESS POSITION IN WORD FORMS", the entirety of which is incorporated herein by reference.

FIELD OF THE TECHNOLOGY

The present technology relates to method and system for automatic determination of stress position in word forms.

BACKGROUND

In linguistics, stress is the relative emphasis that may be given to certain syllables in a word. Stress is typically signaled by such properties as increased loudness and vowel length, full articulation of the vowel, and changes in pitch.

The stress placed on syllables within words is called word stress or lexical stress. Some languages have fixed stress, meaning that the stress on virtually any multi-syllable word falls on a particular syllable, such as the first or the penultimate. Other languages, like English or Russian, have variable stress, where the position of stress in a word is not predictable in that way. Sometimes more than one level of stress, such as primary stress and secondary stress, may be identified.

In many languages, like in English or Russian, traditional writing does not show the stress position in a word. Determining a correct stress position in words in absence of the respective information is a peculiar problem known in computer technologies. A person, while reading texts where stress positions are not marked, still pronounces words correctly, because they have learned how a particular word has to be pronounced, or they may feel it intuitively and in most cases they are correct. In contrast, known computing devices may pronounce correctly either known word forms, when these known word forms are stored in computer readable storage medium in association with the correct stress position (a first "dictionary approach"). Known computing devices may also pronounce correctly unknown word forms ("new words") if they can determine stress position of an unknown word form by calculating a probable stress position (a second "frequency analysis" approach).

Both the first and the second approaches have drawbacks. The first known "dictionary" approach can be applied to known word forms. One of its drawbacks is that it does not work when a word form is "unknown" for the computing device (a new word), i.e. that that word form is absent from the accessible list of word forms associated with stress positions. One could see a possible solution in generating a list of all known word forms associated with the stress position. However, this task is not easy as it may appear at the first glance. To better illustrate a depth of the challenge, we will mention that linguists cannot arrive at a consensus how many words are in Russian language: 140,000, or 200,000, or more. Moreover, in some languages, such like in Russian language, word forms of a given word can vary a lot: in social networks, a picture is circulating which demonstrates over 100 Russian word forms which correspond to only four English word forms "run", "runs", "ran", "running". The problem is further exacerbated by existence of neologisms. The problem is also further exacerbated by the fact that some uses of certain words (for example, when used by users of social networks) may be intentionally mis-used with intentionally committed errors, whereby the correct stress position is still obvious for humans.

The second known "frequency analysis" approach for determining stress positions (sometimes considered to be subsidiary approach) can be applied to unknown word forms. The frequency analysis approach includes analyses (by a computer apparatus) frequency of a particular stress position in a particular context and calculates probability of a particular stress position depending on affixes.

For example, the U.S. Pat. No. 7,356,468 B2 "Lexical stress prediction" teaches using affixes to predict stress positions: "In an embodiment, at least one of the models comprises correlations between word affixes and the position within words of the lexical stress. In general, the affix may be a prefix, suffix or infix. The correlations may be either positive or negative correlations between affix and position. Additionally, the system returns a high percentage accuracy for certain affixes, without the need for the word to pass through every model in the system." According to Wikipedia, article "Affix", "[a]ffixes are divided into plenty of categories, depending on their position with reference to the stem."

This approach, using affixes to predict stress positions, requires, in many instances, an immense training set and, secondly, a lot of computational resources for real-time processing.

SUMMARY

Developers of the present technology have realized that there is a need for a computing system and a method which would allow for a computer system to generate a spoken utterance (while for detecting correct stress positions in words) of a written text while using less computational resources of computer processors.

It is thus an object of the present technology to ameliorate at least some of the inconveniences present in the prior art.

In one aspect, implementations of the present technology provide a method for building a reference system for determining, by a computing device, a stress position of a new word form. The method comprises: sorting, in a reverse lexicographic order, a plurality of word forms, each word form of the plurality of word forms being marked with a particular stress position, in order to generate a plurality of sorted word forms, clustering the plurality of sorted word forms into a plurality of clusters of word forms such that the plurality of clusters of word forms comprises a plurality of terminal clusters, each terminal cluster of the plurality of terminal clusters comprising word forms having both: (i) a same ending being a terminal common ending, and (ii) a same stress position, combination of the terminal common ending and that same stress position being unique; building, using the plurality of terminal clusters, the reference system for determining the stress position of the new word form, the reference system having a reference to at least one terminal cluster of the plurality of terminal clusters, the at least one terminal cluster comprising an indication of the particular stress position proper to word forms which are included in that respective terminal cluster.

In some implementations, the terminal common ending, within any terminal cluster, is an ending of a word forms comprising in an immediately preceding superior level cluster and also an additional letter.

In some implementations, clustering the plurality of sorted word forms into a plurality of clusters of word forms further comprises organizing the plurality of clusters into a hierarchical tree-structure of clusters, the organizing being performed such that: (i) the plurality of clusters of word forms comprises: (a) a plurality of root clusters, each root cluster having at least one immediately following lower level cluster, and (b) the plurality of terminal clusters, each terminal cluster of the plurality of terminal clusters having no lower level cluster; (ii) at least some clusters of the hierarchical tree-structure, in respect to each other, are immediately preceding superior level clusters and immediately following lower level clusters, and (iii) an ending of a word form in a immediately following lower level cluster has a same sequence of letters as in a immediately preceding superior level cluster and also an additional letter.

In some implementations, the hierarchical tree-structure of clusters further comprises a plurality of internal clusters, each internal cluster being the immediately following lower level cluster of an immediately preceding superior level cluster and the immediately preceding superior level cluster in respect to at least one immediately following lower level cluster.

In some implementations, word forms, the word forms having the same ending being the terminal common ending, have at least two different stress positions, the method further comprises generating at least two terminal clusters, each of these at least two terminal clusters comprising word forms having: that terminal common ending, and one respective same stress position, and a number of occurrences of that one respective same stress position.

In some implementations, the method further comprises, before the sorting the plurality of word forms, acquiring, from a supplying device, the plurality of word forms.

In some implementations, the acquiring the plurality of word forms comprises acquiring at least one word form of the plurality of word forms being marked with the particular stress position.

In some implementations, the acquiring the plurality of word forms is acquiring from at least one literature source.

In some implementations, word forms are word forms of a particular language.

In some implementations, word forms are Russian-language word forms.

In some implementations, the method further comprises receiving a request for defining the stress position of the new word form and, responsive to receiving the request: using a new ending of the new word form for finding, in the reference system for endings, a corresponding terminal cluster having matching terminal common ending, and applying to the new word form that stress position which corresponds to a stress position of word forms being included into the corresponding terminal cluster.

In some implementations, the method further comprises receiving a request for defining the stress position of the new word form and, responsive to receiving the request: using a new ending of the new word form for finding, in the reference system for endings, these at least two terminal clusters, and applying to the new word form that stress position which corresponds to a stress position of word forms being in that one of these at least two terminal clusters, which terminal cluster has a highest number of occurrences of a particular stress position.

In some implementations, the using the new ending of the new word form is any one, selected from: (i) using the new ending of the new word form as a key, and (ii) using a reversed sequence of letters in the new ending of the new word form as a sequence of keys.

In another aspect, embodiments of the present technology provide a computing device for building a reference system for determining a stress position of a new word form. The computing device comprises a processor. The computing device comprises an information storage medium. The information storage medium stores computer-readable instructions. The computer-readable instructions, when executed by the processor, cause the processor to perform: sorting, in a reverse lexicographic order, a plurality of word forms, each word form of the plurality of word forms being marked with a particular stress position, in order to generate a plurality of sorted word forms, clustering the plurality of sorted word forms into a plurality of clusters of word forms such that the plurality of clusters of word forms comprises a plurality of terminal clusters, each terminal cluster of the plurality of terminal clusters comprising word forms having both: (i) a same ending being a terminal common ending, and (ii) a same stress position, combination of the terminal common ending and that same stress position being unique; building, using the plurality of terminal clusters, the reference system for determining the stress position of the new word form, the reference system having a reference to at least one terminal cluster of the plurality of terminal clusters, the at least one terminal cluster comprising an indication of the particular stress position proper to word forms which are included in that respective terminal cluster.

In some embodiments, the terminal common ending, within any terminal cluster, is an ending of a word forms comprising in an immediately preceding superior level cluster and also an additional letter.

In some embodiments, clustering the plurality of sorted word forms into a plurality of clusters of word forms further comprises organizing the plurality of clusters into a hierarchical tree-structure of clusters, the organizing being performed by the processor such that: (i) the plurality of clusters of word forms comprises: (a) a plurality of root clusters, each root cluster having at least one immediately following lower level cluster, and (b) the plurality of terminal clusters, each terminal cluster of the plurality of terminal clusters having no lower level cluster; (ii) at least some clusters of the hierarchical tree-structure, in respect to each other, are immediately preceding superior level clusters and immediately following lower level clusters, and (iii) an ending of a word form in a immediately following lower level cluster has a same sequence of letters as in a immediately preceding superior level cluster and also an additional letter.

In some embodiments, the hierarchical tree-structure of clusters further comprises a plurality of internal clusters, each internal cluster being the immediately following lower level cluster of an immediately preceding superior level cluster and the immediately preceding superior level cluster in respect to at least one immediately following lower level cluster.

In some embodiments, word forms, the word forms having the same ending being the terminal common ending, have at least two different stress positions, and wherein the computer-readable instructions, when executed by the processor, further cause the processor to generate at least two terminal clusters, each of these at least two terminal clusters comprising word forms having: that terminal common ending, and one respective same stress position, and a number of occurrences of that one respective same stress position.

In some embodiments, the computer-readable instructions, when executed by the processor, further cause the processor, before the sorting the plurality of word forms, to acquire, from a supplying device, the plurality of word forms.

In some embodiments, the acquiring the plurality of word forms comprises acquiring at least one word form of the plurality of word forms, being marked with the particular stress position.

In some embodiments, the acquiring the plurality of word forms is acquiring from at least one literature source.

In some embodiments, word forms are word forms of a particular language.

In some embodiments, word forms are Russian-language word forms.

In some embodiments, the computer-readable instructions, when executed by the processor, further cause the processor to receive a request for defining the stress position of the new word form and, responsive to receiving the request: to use a new ending of the new word form for finding, in the reference system for endings, a corresponding terminal cluster having matching terminal common ending, and to apply to the new word form that stress position which corresponds to a stress position of word forms being included into the corresponding terminal cluster.

In some embodiments, the computer-readable instructions, when executed by the processor, further cause the processor to receive a request for defining the stress position of the new word form and, responsive to receiving the request: to use a new ending of the new word form for finding, in the reference system for endings, these at least two terminal clusters, and to apply to the new word form that stress position which corresponds to a stress position of word forms being in that one of these at least two terminal clusters, which terminal cluster has a highest number of occurrences of a particular stress position.

In some embodiments, the using the new ending of the new word form is any one, selected from: (i) using the new ending of the new word form as a key, and (ii) using a reversed sequence of letters in the new ending of the new word form as a sequence of keys.

In the context of the present specification, unless specifically provided otherwise, a "server" is a computer program that is running on appropriate hardware and is capable of receiving requests (e.g. from client devices) over a network, and carrying out those requests, or causing those requests to be carried out. The hardware may be one physical computer or one physical computer system, but neither is required to be the case with respect to the present technology. In the present context, the use of the expression a "server" is not intended to mean that every task (e.g. received instructions or requests) or any particular task will have been received, carried out, or caused to be carried out, by the same server (i.e. the same software and/or hardware); it is intended to mean that any number of software elements or hardware devices may be involved in receiving/sending, carrying out or causing to be carried out any task or request, or the consequences of any task or request; and all of this software and hardware may be one server or multiple servers, both of which are included within the expression "at least one server".

In the context of the present specification, unless specifically provided otherwise, an expression "word form" means various forms of words, including dictionary form words. For example: a, an, run, runs, running, ran, child, children, white, whiter, whites, whiting, whited, and so on.

In the context of the present specification, unless specifically provided otherwise, an expression "reverse lexicographic order" means that, when in a particular language word forms are written from left to right, word forms are sorted in alphabetical order but the letters are compared by reading from the right to left, instead of from left to right. When in a particular language, however, word forms are written from right to left, the expression "reverse lexicographic order" means that the letters are compared by reading from left to right.

In the context of the present specification, unless specifically provided otherwise, an expression "ending" means certain number of last letters of a word form. For example, the word form "running" can have seven different endings: "g", "ng", "ing", "ning", "nning", "unning", "running". It is possible, that different word forms have at least one same ending. For example, word forms "running" and "biking" have three common endings: "ing", "ng", 'g".

In the context of the present specification, unless specifically provided otherwise, a "database" is any structured collection of data, irrespective of its particular structure, the database management software, or the computer hardware on which the data is stored, implemented or otherwise rendered available for use. A database may reside on the same hardware as the process that stores or makes use of the information stored in the database or it may reside on separate hardware, such as a dedicated server or plurality of servers.

In the context of the present specification, unless specifically provided otherwise, the word "cluster" has been used to denote a sub-set of objects (such as word forms, but not limited thereto), virtually organized based on their relative characteristics. The process of organizing of objects into the clusters can be referred to as clustering.

In the context of the present specification, unless specifically provided otherwise, the expression "information" includes information of any nature or kind whatsoever, comprising information capable of being stored in a database. Thus information includes, but is not limited to data (map data, location data, coordinates, numerical data, etc.), audiovisual works (photos, movies, sound records, presentations etc.), text (opinions, comments, questions, messages, etc.), documents, spreadsheets, etc.

In the context of the present specification, unless specifically provided otherwise, the expression "component" is meant to include software (appropriate to a particular hardware context) that is both necessary and sufficient to achieve the specific function(s) being referenced.

In the context of the present specification, unless specifically provided otherwise, the expression "information storage medium" is intended to include media of any nature and kind whatsoever, including RAM, ROM, disks (CD-ROMs, DVDs, floppy disks, hard drivers, etc.), USB keys, solid state-drives, tape drives, etc.

In the context of the present specification, unless specifically provided otherwise, the words "first", "second", "third", etc. have been used as adjectives only for the purpose of allowing for distinction between the nouns that they modify from one another, and not for the purpose of describing any particular relationship between those nouns. Thus, for example, it should be understood that, the use of the terms "first word form" and "third word form" is not intended to imply any particular order, type, chronology, hierarchy or ranking (for example) of/between the points, nor is their use (by itself) intended imply that any "second word form" must necessarily exist in any given situation. Further, as is discussed herein in other contexts, reference to a "first" element and a "second" element does not preclude the two elements from being the same actual real-world element. Thus, for example, in some instances, a "first"

element and a "second" element may be the same element, in other cases they may be different elements.

Implementations of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects and advantages of implementations of the present technology will become apparent from the following description, the accompanying drawings and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

Figure 1:
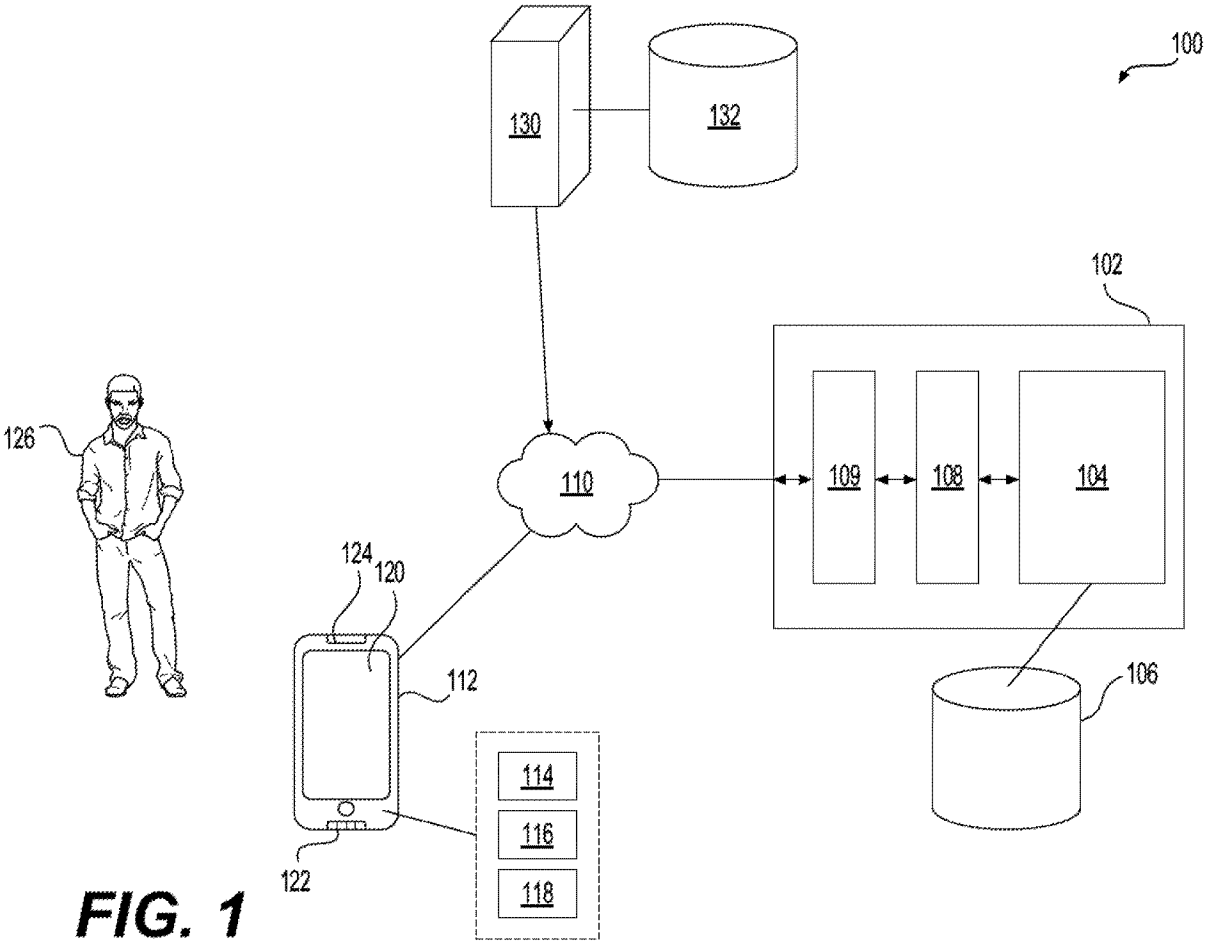
FIG. 1 is a schematic diagram of a system implemented in accordance with an embodiment of the present technology.

The examples and conditional language recited herein are principally intended to aid the reader in understanding the principles of the present technology and not to limit its scope to such specifically recited examples and conditions. It will be appreciated that those skilled in the art may devise various arrangements which, although not explicitly described or shown herein, nonetheless embody the principles of the present technology and are included within its spirit and scope.

Furthermore, as an aid to understanding, the following description may describe relatively simplified implementations of the present technology. As persons skilled in the art would understand, various implementations of the present technology may be of a greater complexity.

In some cases, what are believed to be helpful examples of modifications to the present technology may also be set forth. This is done merely as an aid to understanding, and, again, not to define the scope or set forth the bounds of the present technology. These modifications are not an exhaustive list, and a person skilled in the art may make other modifications while nonetheless remaining within the scope of the present technology. Further, where no examples of modifications have been set forth, it should not be interpreted that no modifications are possible and/or that what is described is the sole manner of implementing that element of the present technology.

Moreover, all statements herein reciting principles, aspects, and implementations of the present technology, as well as specific examples thereof, are intended to encompass both structural and functional equivalents thereof, whether they are currently known or developed in the future. Thus, for example, it will be appreciated by those skilled in the art that any block diagrams herein represent conceptual views of illustrative circuitry embodying the principles of the present technology. Similarly, it will be appreciated that any flowcharts, flow diagrams, state transition diagrams, pseudo-code, and the like represent various processes which may be substantially represented in computer-readable media and so executed by a computer or processor, whether or not such computer or processor is explicitly shown.

The functions of the various elements shown in the figures, including any functional block labeled as a "processor" or a "word form processing unit" and the like, may be provided through the use of dedicated hardware as well as hardware capable of executing software in association with appropriate software. When provided by a processor, the functions may be provided by a single dedicated processor, by a single shared processor, or by a plurality of individual processors, some of which may be shared. In some embodiments of the present technology, the processor may be a general purpose processor, such as a central processing unit (CPU) or a processor dedicated to a specific purpose, such as a word form processing unit (WFPU). Moreover, explicit use of the term "processor" or "controller" should not be construed to refer exclusively to hardware capable of executing software, and may implicitly include, without limitation, digital signal processor (DSP) hardware, network processor, application specific integrated circuit (ASIC), field programmable gate array (FPGA), read-only memory (ROM) for storing software, random access memory (RAM), and non-volatile storage. Other hardware, conventional and/or custom, may also be included.

Software modules, or simply modules which are implied to be software, may be represented herein as any combination of flowchart elements or other elements indicating performance of process steps and/or textual description. Such modules may be executed by hardware that is expressly or implicitly shown.

With these fundamentals in place, we will now consider some non-limiting examples to illustrate various implementations of aspects of the present technology.

Referring to FIG. 1, there is shown a diagram of a system 100, the system 100 being suitable for implementing non-limiting embodiments of the present technology. The system 100 may comprise inter alia a server 102, a communication network 110, a client device 112, and a word form a supplying device 130.

It is to be expressly understood that the system 100 is depicted as merely as an illustrative implementation of the present technology. Thus, the description thereof that follows is intended to be only a description of illustrative examples of the present technology. This description is not intended to define the scope or set forth the bounds of the present technology. In some cases, what are believed to be helpful examples of modifications to the system 100 may also be set forth below. This is done merely as an aid to understanding, and, again, not to define the scope or set forth the bounds of the present technology. These modifications are not an exhaustive list, and, as a person skilled in the art would understand, other modifications are likely possible. Further, where this has not been done (i.e. where no examples of modifications have been set forth), it should not be interpreted that no modifications are possible and/or that what is described is the sole manner of implementing that element of the present technology. As a person skilled in the art would understand, this is likely not the case. In addition it is to be understood that the system 100 may provide in certain instances simple implementations of the present technology, and that where such is the case they have been presented in this manner as an aid to understanding. As persons skilled in the art would understand, various implementations of the present technology may be of a greater complexity.

System 100 includes the server 102. The server 102 may be implemented as a conventional computer server. In an example of an embodiment of the present technology, the server 102 may be implemented as a Dell™ PowerEdge™ Server running the Microsoft™ Windows Server™ operating system. Needless to say, the server 102 may be implemented in any other suitable hardware and/or software and/or firmware or a combination thereof. In the depicted non-limiting embodiment of present technology, the server 102 is a single server. In alternative non-limiting embodiments of the present technology, the functionality of the server 102 may be distributed and may be implemented via multiple servers.

The server 102 includes an information storage medium 104 that may be used by the server 102. Generally, the information storage medium 104 may be implemented as a medium of any nature and kind whatsoever, including RAM, ROM, disks (CD-ROMs, DVDs, floppy disks, hard drivers, etc.), USB keys, solid state-drives, tape drives, etc. and also the combinations thereof.

The implementations of the server 102 are well known in the art. So, suffice it to state, that the server 102 comprises inter alia a network communication interface 109 (such as a modem, a network card and the like) for two-way communication over a communication network 110; and a processor 108 coupled to the network communication interface 109 and the information storage medium 104, the processor 108 being configured to execute various routines, including those described herein below. To that end the processor 108 may have access to computer readable instructions stored on the information storage medium 104, which instructions, when executed, cause the processor 108 to execute the various routines described herein.

In some non-limiting embodiments of the present technology, the communication network 110 can be implemented as the Internet. In other embodiments of the present technology, the communication network 110 can be implemented differently, such as any wide-area communication network, local-area communication network, a private communication network and so on.

The information storage medium 104 is configured to store data, including computer-readable instructions and other data, including lexical units of kind. In some implementations of the present technology, the information storage medium 104 can store at least part of the data in a database 106. In other implementations of the present technology, the information storage medium 104 can store at least part of the data in any collections of data other than databases.

The information storage medium 104 can store computer-readable instructions that manage control, updates, populating and modifications of the database 106 and/or other collections of data. More specifically, computer-readable instructions stored on the information storage medium 104 cause the server 102 to receive (to update) collection of word forms (for example, via the communication network 110), to store word forms and texts in the database 106, and/or in other collections of data.

Data stored on the information storage medium 104 (and more particularly, at least in part, in some implementations, in the database 106) can comprise plurality of word forms, including word forms being marked with a particular stress position. Data stored on the information storage medium 104 (and more particularly, at least in part, in some implementations, in the database 106) can be sorted and organized in clusters, in sub-pluralities of word forms, and so on. The information storage medium 104 (including the database 106) can separately store several pluralities of word forms, each plurality comprising word forms of a particular language. Word forms of each particular language can be processed by the processor 108 separately.

Computer-readable instructions, stored on the information storage medium 104, when executed, can cause the processor 108 to acquire a plurality of word forms. In some implementations, at least some received word forms of the plurality of word forms can be marked with a respective stress position. In other implementations, at least some received word forms of the plurality of word forms can be not marked with a respective stress position.

The word forms can be received from any suitable source. As a non-limiting example, they can be received from a dictionary comprising word forms marked with respective stress position. As another non-limiting example, they can be received from at least one literature source, such as a text of the "Crime and Punishment" by Fyodor Dostoyevsky, and/or "Uncle Fedya, His Dog, and His Cat" by Eduard Uspensky, and/or other pieces of literature. The word forms can be received from any suitable external device, for examples from the supplying device 130, which can be an external computing device storing on its computer readable information storage medium a database 132 comprising word forms being marked with a respective stress position. The word forms can also be received from an external computer readable information storage medium, or an external peripheral device such like scanner, and so on. When received word forms are not marked with the respective stress position, the respective stress position of the respective word form has to be marked thereafter using any suitable means and/or methods. For example, respective stress positions can be marked by human operators operating suitable computing devices.

Computer-readable instructions, stored on the information storage medium 104, when executed, can cause the processor 108 to store received and marked with the respective stress position word forms in the database 106.

Computer-readable instructions, stored on the information storage medium 104, when executed, can cause the processor 108 to sort, in a reverse lexicographic order, the plurality of word forms being marked with a particular stress position. As a result, a plurality of sorted word forms can be generated. The method of sorting, in a reverse lexicographic order, a plurality of word forms is described in details below at step 404 of a method 400.

Figure 2:
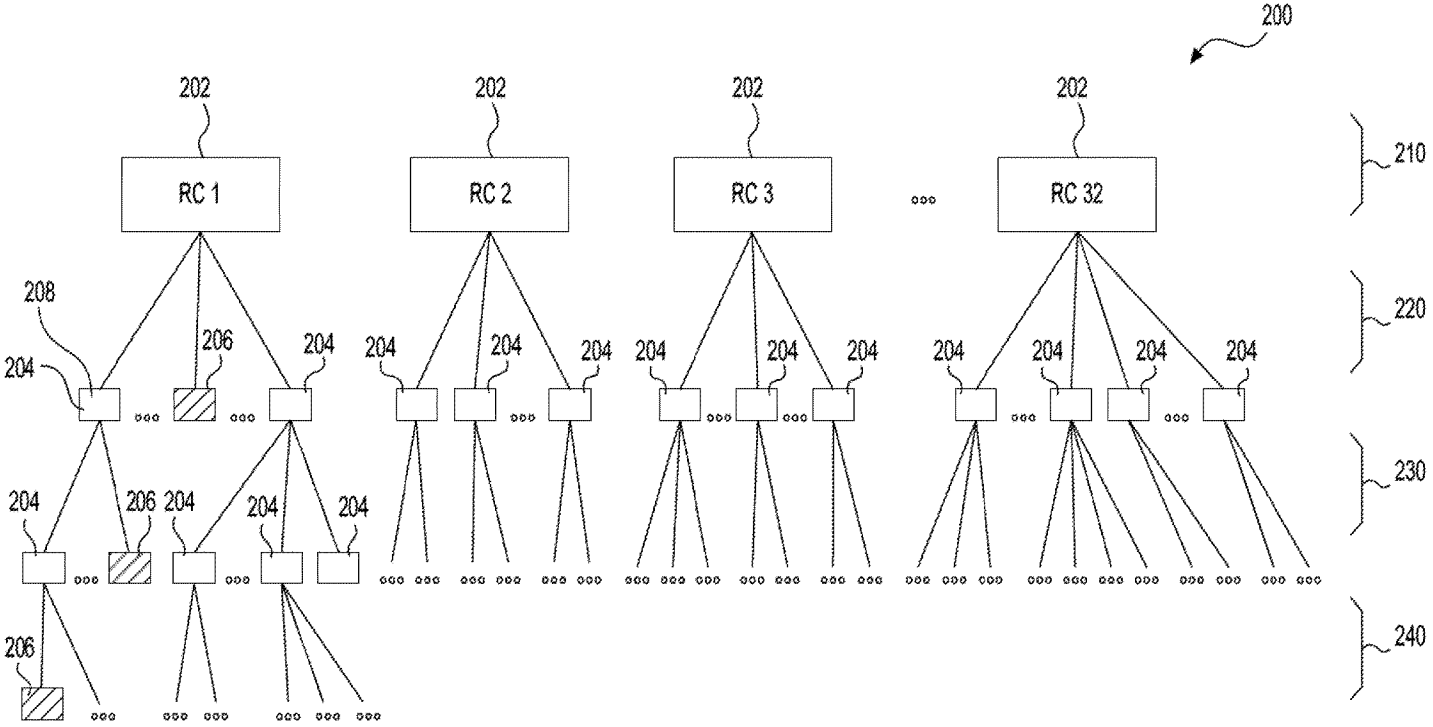
FIG. 2 depicts a non-limiting example of a hierarchical tree-structure of clusters, the hierarchical tree-structure of clusters being implemented in accordance with non-limiting embodiments of the present technology.

Computer-readable instructions, stored on the information storage medium 104, when executed, can cause the processor 108 to cluster the plurality of sorted word forms into a plurality of clusters. The plurality of clusters can comprise a plurality of root clusters. The plurality of clusters can comprise a plurality of internal clusters. The plurality of clusters can comprise a plurality of terminal clusters. The processor 108 can organize the plurality of clusters into a hierarchical tree-structure of clusters, as illustrated in FIG. 2 and will be described in details below at step 406 of the method 400.

Computer-readable instructions, stored on the information storage medium 104, when executed, can cause the processor 108, using the plurality of terminal clusters, to build a reference system for determining the stress position of a new word form. The processor 108 can build the reference system as an index based on a hierarchical tree structure having plurality of root nodes, each root node having child nodes. Each node is a data structure comprising a value. Each non-terminal node comprises data comprising the value together with a list of references to child nodes. The hierarchical tree structure can mirror the hierarchical cluster structure described above. The value in each root node can be the same letter as in a respective root cluster 202 of the first level 210. The value in each node of the following level can correspond to the combination of letters in the respective cluster of the second level 220, and so on. Each terminal node comprises data comprising the value, the value being identical to a terminal common ending, together with at least one reference to the at least one terminal cluster, the at least one terminal cluster having the same terminal common ending.

Computer-readable instructions, stored on the information storage medium 104, when executed, can cause the processor 108 to receive a request for defining the stress position of the new word form. The request can be received, for example, from the client device 112 over the communications network 110. The request can be a sentence comprising several word forms, including a new word a stress position in which is not stored in the database 106 of the server 102.

Computer-readable instructions, stored on the information storage medium 104, when executed, can cause the processor 108, responsive to receiving that request, to use a new ending of the new word form for finding, in the reference system for endings, a corresponding terminal cluster having matching terminal common ending, and to apply to the new word form that stress position which corresponds to a stress position of word forms being included into the corresponding terminal cluster.

Computer-readable instructions, stored on the information storage medium 104, when executed, can cause the processor 108 to apply to the new word form that stress position which corresponds to a stress position of word forms being included into the corresponding terminal cluster. For example, the stress position of word forms being included into the corresponding terminal cluster 306 is on the second vowel from the end of the word form. Therefore, the processor 108 will apply that stress position to the new word "проверяя" (the stress position: "проверЯя").

As it was mentioned above, in some implementations, existence of two or more terminal clusters having the same a terminal common ending is possible. In this case, the reference system for determining the stress position of the new word form would have several references to several terminal clusters. If this is the case, the computer-readable instructions, stored on the information storage medium 104, when executed, can cause the processor 108 to apply to the new word form that stress position which corresponds to a stress position of word forms being in that one of these at least two terminal clusters, which terminal cluster has a highest number of occurrences of a particular stress position. Selecting the most frequent stress position would lessen the risk of applying a wrong stress position.

The system 100 further comprises a client device 112. The client device 112 can be implemented as an Apple™ iPhone 5s electronic device. The client device 112 is typically associated with a user 126. The client device 112 is a kind of a computing device. It should be noted that the fact that the client device 112 is associated with the user does not need to suggest or imply any mode of operation—such as a need to log in, a need to be registered or the like.

The implementation of the client device 112 is not particularly limited. The client device 112 may be alternatively implemented as any other wireless communication device (a smartphone, a tablet and the like), or as a personal computer (desktops, laptops, netbooks, etc.).

The client device 112 comprises a multi-touch display 120. The multi-touch display 120 is 1114-inch (diagonal) Retina display 1136-by-640 resolution 326 ppi, as an example.

The multi-touch display 120 can be used for displaying information, including displaying a graphical user interface. Amongst other things, the multi-touch display 120 can display texts which the user 126 may potentially want the client device 112 to generate a spoken utterance of.

The multi-touch display 120 can also be used for receiving user input. For example, the user 126 (who may be a non-native speaker language, as an example) may enter (or otherwise select), using the multi-touch display 120, Russian word forms and/or sentences. The user 126 may be desirous of causing the client device 126 to generate a spoken utterance of the so-entered word forms and/or sentences. For example, the user 126 may be unsure of the correct pronunciation of the so-entered word forms and/or sentences (including the correct stress positions in the individual word forms).

The client device 112 can comprise a processor 116. In particular embodiments, the processor 116 can comprise one or more processors and/or one or more microcontrollers configured to execute instructions and to carry out operations associated with the operation of the client device 112. In various embodiments, processor 116 can be implemented as a single-chip, multiple chips and/or other electrical components including one or more integrated circuits and printed circuit boards. Processor 116 can optionally contain a cache memory unit (not depicted) for temporary local storage of instructions, data, or computer addresses. By way of example, the processor 116 can include one or more processors or one or more controllers dedicated for certain processing tasks of the client device 112 or a single multi-functional processor or controller.

The processor 116 is operatively coupled to a memory module 114. Memory module 114 can encompass one or more storage media and generally provide a place to store computer code (e.g., software and/or firmware) or user data (e.g., photos, text data, indexes etc.). By way of example, the memory module 114 can include various tangible computer-readable storage media including Read-Only Memory (ROM) and/or Random-Access Memory (RAM). As is well known in the art, ROM acts to transfer data and instructions uni-directionally to the processor 116, and RAM is used typically to transfer data and instructions in a bi-directional manner. Memory module 114 can also include one or more fixed storage devices in the form of, by way of example, hard disk drives (HDDs), solid-state drives (SSDs), flash-memory cards (e.g., Secured Digital or SD cards, embedded MultiMediaCard or eMMD cards), among other suitable forms of memory coupled bi-directionally to the processor 116. Information can also reside on one or more removable storage media loaded into or installed in the client device 112 when needed. By way of example, any of a number of suitable memory cards (e.g., SD cards) can be loaded into the client device 112 on a temporary or permanent basis.

The memory module 114 can store inter alia a series of computer-readable instructions, which instructions when executed cause the processor 116 (as well as other components of the client device 112) to execute the various operations described herein.

The memory module 114 can store computer-readable instructions, which instructions when executed cause the processor 116 to send word forms, entered by the user 126, to the server 102 over the communication network 110 in order to receive, from the server 102, instructions to pronounce the word forms.

The client device 112 further comprises an output module 122. Output module 122 can comprise one or more output devices operably connected to processor 116. For example, in one implementation of the client device 112, as shown in FIG. 1, output module 122 of the client device 112 comprises the multi-touch display 120 being in this implementation 1114-inch (diagonal) Retina display 1136-by-640 resolution 326 ppi, and loudspeaker 124 (Voice 68 dB/Noise 66 dB/Ring 69 dB). The loudspeaker 124 allows the user to listen the pronunciation of word forms, including new word forms.

The client device 112 further comprises wireless communication module 118 which can be designed to operate over one or more wireless networks, for example, a wireless PAN (WPAN) (such as, for example, a BLUETOOTH WPAN, an infrared PAN), a WI-FI network (such as, for example, an 802.11a/b/g/n WI-FI network, an 802.11s mesh network), a WI-MAX network, a cellular telephone network (such as, for example, a Global System for Mobile Communications (GSM) network, an Enhanced Data Rates for GSM Evolution (EDGE) network, a Universal Mobile Telecommunications System (UMTS) network, and/or a Long Term Evolution (LTE) network). Additionally, wireless communication module 118 can include hosting protocols such that client device 112 can be configured as a base station for other wireless devices.

Sensor module can include one or more sensor devices to provide additional input and facilitate multiple functionalities of the client device 112.

In particular embodiments, various components of client device 112 can be operably connected together by one or more buses (including hardware and/or software). As an example and not by way of limitation, the one or more buses can include an Accelerated Graphics Port (AGP) or other graphics bus, an Enhanced Industry Standard Architecture (EISA) bus, a front-side bus (FSB), a HYPERTRANSPORT (HT) interconnect, an Industry Standard Architecture (ISA) bus, an INFINIBAND interconnect, a low-pin-count (LPC) bus, a memory bus, a Micro Channel Architecture (MCA) bus, a Peripheral Component Interconnect (PCI) bus, a PCI-Express (PCI-X) bus, a serial advanced technology attachment (SATA) bus, a Video Electronics Standards Association local (VLB) bus, a Universal Asynchronous Receiver/Transmitter (UART) interface, a Inter-Integrated Circuit (I2C) bus, a Serial Peripheral Interface (SPI) bus, a Secure Digital (SD) memory interface, a MultiMediaCard (MMC) memory interface, a Memory Stick (MS) memory interface, a Secure Digital Input Output (SDIO) interface, a Multi-channel Buffered Serial Port (McBSP) bus, a Universal Serial Bus (USB) bus, a General Purpose Memory Controller (GPMC) bus, a SDRAM Controller (SDRC) bus, a General Purpose Input/Output (GPIO) bus, a Separate Video (S-Video) bus, a Display Serial Interface (DSI) bus, an Advanced Microcontroller Bus Architecture (AMBA) bus, or another suitable bus or a combination of two or more of these.

How the communication link is implemented is not particularly limited and will depend on how the client device 112 is implemented. Merely as an example and not as a limitation, in those embodiments of the present technology where the client device 112 is implemented as a wireless communication device (such as a smartphone), the communication link can be implemented as a wireless communication link (such as but not limited to, a 3G communications network link, a 4G communications network link, a Wireless Fidelity, or WiFi® for short, Bluetooth® and the like). In those examples, where the client device 112 is implemented as a notebook computer, the communication link can be either wireless (such as the Wireless Fidelity, or WiFi® for short, Bluetooth® or the like) or wired (such as an Ethernet based connection).

It should be expressly understood that implementations for the client device 112, the communication link and the communication network 110 are provided for illustration purposes only. As such, those skilled in the art will easily appreciate other specific implementation details for the client device 112, the communication link and the communication network 110. As such, by no means, examples provided herein above are meant to limit the scope of the present technology.

Figure 4:
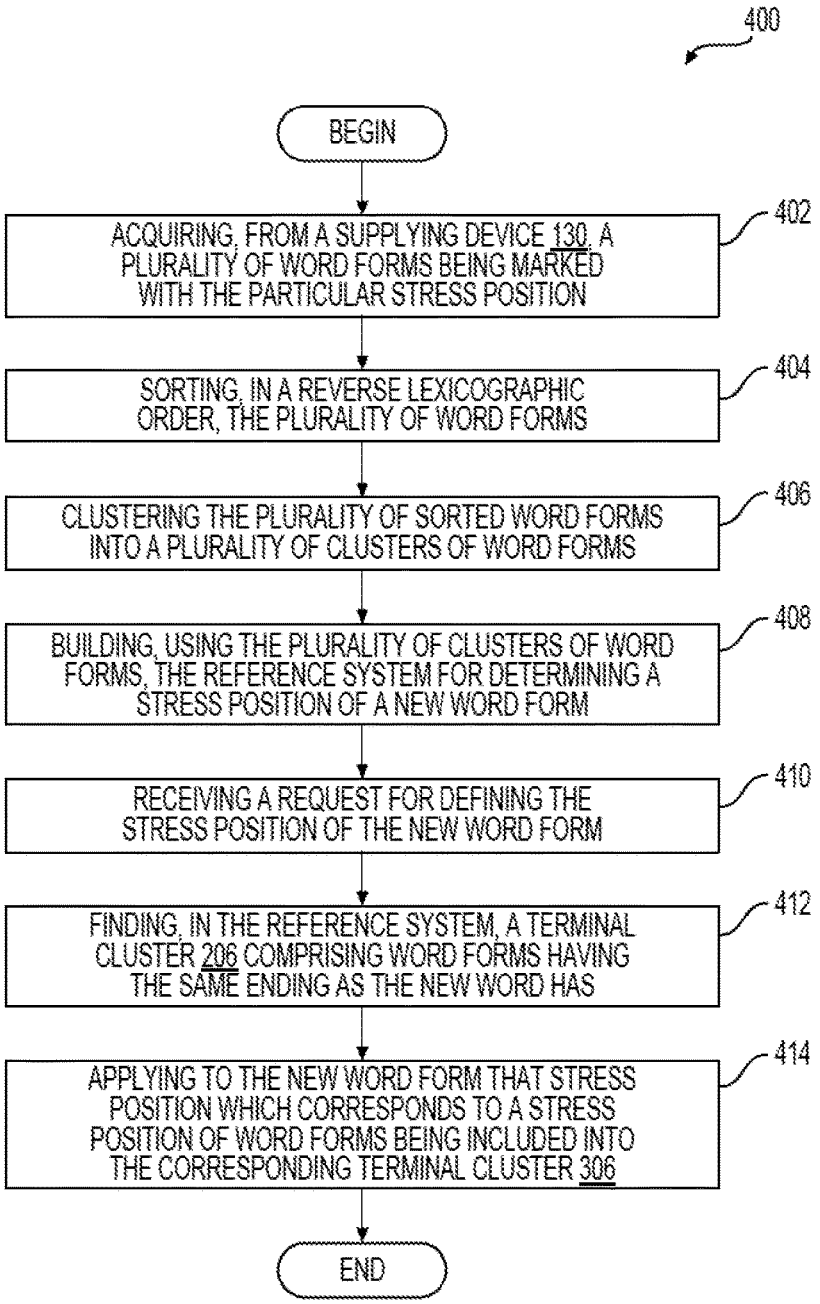
FIG. 4 is a block-diagram illustrating computer-implemented method for building a reference system for determining a stress position of a new word form, the method being executed by a server of the system of FIG. 1, the method being executed in accordance with a non-limiting example of the present technology.

FIG. 4 is a block-diagram illustrating computer-implemented method 400 for building a reference system for determining a stress position of a new word form, the method being executed by a server 102 of the system 100 of FIG. 1, the method 400 being executed in accordance with a non-limiting example of the present technology.

Step 402—Acquiring, from a Supplying Device 130, the Plurality of Word Forms Being Marked with the Particular Stress Position The method 400 starts at step 402, where the server 102 acquires, from a supplying device 130, the plurality of word forms being marked with the particular stress position. The supplying device 130 is in this implementation an external server storing on its computer readable information storage medium a database 132 comprising word forms being marked with a respective stress position. The database 132, in this implementation, comprises word forms being marked with a respective stress position. The word forms being stored in the data base 132 originate from several sources, including various pieces of literature, dictionaries, technical literature, and various manuals.

The word forms being acquired are, in this non-limiting implementation, Russian-language word forms. Therefore, all following steps of method 400 will be illustrated with reference to Russian-language word forms.

However, the present technology is not limited to detecting stress positions of Russian-language word forms. Alternative implementations of the present technology can be used for detecting stress positions in word forms written in other languages, provided that there is correlation between stress positions and endings of word forms in that respective language.

Then, the method 400 proceeds to the step 404.

Step 404—Sorting, in a Reverse Lexicographic Order, a Plurality of Word Forms

Then, at step 404, the processor 108 sorts, in a reverse lexicographic order, a plurality of word forms, each word form of the plurality of word forms being marked with a particular stress position. As a result, a plurality of sorted word forms is generated. The plurality of sorted word forms can be stored on a computer readable information storage medium 104 in the database 106.

For example, processor 108 can sort, in a reverse lexicographic order, the plurality of Russian word forms from the database 106, the word forms being marked with a particular stress position. The Russian alphabet comprises 33 letters, starting with "а", "б", "в", "Г" and so on and finishing with the letter "Я", the last letter of the Russian alphabet. The processor 108 can detect that in the database 106, there are 13927 word forms ending with the letter "а", 448 word forms ending with the letter "б"; 5654 word forms ending with the letter "в"; 873 word forms ending with the letter "Г", and so on. The processor 108 can sort all word forms in the database 106 in order to generate a list where the first 13927 word forms end with the letter "а", the following 448 word forms end with the letter "б", the following 5654 word forms end with the letter "в", the following 873 word forms end with the letter "Г", and so on, finishing with 8820 word forms ending with the letter "Я", the last letter of the Russian alphabet.

Thereafter, the processor 108 can reorder the first 13927 word forms by sorting the first 13927 word forms by the second letter from the end. For example, the processor 108 can check if there are word forms ending with "аа" (we remind that "а" is the first letter of the Russian alphabet). Having detected that there is no word forms ending "аа" in the database 106, the processor can check if there are word forms ending with "б а" (we remind that "б" is the second letter of the Russian alphabet). The processor 108 can find that 99 word forms ending with "б а": суДЬ б а, б а б а, о б а, З Л о б а, не б а, х Л е б а, and so on. Then, the processor can determine that there are 617 word forms ending with "ва" (we remind that "в" is the third letter of the Russian alphabet). As a result, the first 13927 word forms will begin with 99 word forms ending with "б а", following with 617 word forms ending with "ва", and so on. Similarly, processor 108 can further sort all word forms by the third letter from the end, by the fourths letter from the end, by the fifths letter from the end, end so on. As a result, the processor 108 can sort the first 13927 word forms ending with "а" into a part of the list starting with the word "б а б z" and ending with the word "товарища".

Thereafter, the processor 108 can reorder the first 99 word forms (99 word forms ending with letters "б а") of the first 13927 word forms (13927 word forms ending with letter "а") by sorting the first 99 word forms ending with letters "б а" of the first 13927 ending with letter "а" word forms by the third letter from the end. For example, the processor 108 can check if there are word forms ending with "а б а" and, if so, put these words in the beginning of these 99 word form list (we remind that "а" is the first letter of the Russian alphabet).

Similarly, the processor 108 can reorder following 448 word forms ending with the letter "б", the following 5654 word forms ending with the letter "в", the following 873 word forms ending with the letter "Г", and so on, finishing with 8820 word forms ending with the letter "Я", the last letter of the Russian alphabet, such that complete list comprises all word forms being stored in the database 106, starting with the word form "б а б а", and ending with the word form "удовлетворяя". As a result of the sorting in the reverse lexicographic order by the processor 108 the plurality of word forms, the word forms being stored in the database 106, a plurality of sorted word forms can be generated.

Then, the method 400 proceeds to the step 406.

Step 406—Clustering the Plurality of Sorted Word Forms into a Plurality of Clusters of Word Forms Then, at step 406, the processor 108 can cluster the plurality of sorted word forms into a plurality of clusters. The plurality of clusters can comprise a plurality of root clusters. The plurality of clusters can comprise a plurality of internal clusters. The plurality of clusters can comprise a plurality of terminal clusters. The processor 108 can organize the plurality of clusters into a hierarchical tree-structure of clusters, as illustrated in FIG. 2.

FIG. 2 illustrates a hierarchical tree-structure 200 of clusters, the hierarchical tree-structure 200 of clusters being implemented in accordance with non-limiting implementations of the present technology. Computer-readable instructions, stored on the information storage medium 104, when executed, can cause the processor 108 to cluster the plurality of sorted word forms into a plurality of clusters of word forms. Computer-readable instructions, stored on the information storage medium 104, when executed, further can cause the processor 108 to organize the plurality of clusters of word forms into the hierarchical tree-structure 200 of clusters. The plurality of clusters of word forms comprises can be organized into the hierarchical tree-structure 200 of clusters such that the hierarchical tree-structure 200 comprises clusters of different categories.

The hierarchical tree-structure 200 of clusters can comprise a plurality of root clusters 202. A root cluster 202 is a cluster which can comprise all word forms of a particular language being stored in database 106, which word forms end with a particular letter. For example, the root cluster 202 RC1 can comprise 13927 word forms ending with the letter "а" being the first letter of the Russian alphabet. The root cluster 202 RC2 can comprise 448 word forms ending with the letter "б". The root cluster 202 RC3 can comprise 5654 word forms ending with the letter "в". The root cluster 202 RC4 can comprise 873 word forms ending with the letter "Г", and so on, ending with the root cluster 202 RC32 with 8820 word forms ending with the last letter of the Russian alphabet "Я". As it was mentioned above, the Russian alphabet comprises 33 letters. However, in this implementation, the number of root clusters 202 is 32, because the processor 108 has found no word form ending with letter "Ь" in database 106. The reason is that in modern Russian language, letter "Ь" is not used in the end of word forms. However, in the case of update of the database 106, if a word form ending with letter "Ь" is eventually added (lets imagine a neologism), an additional root cluster 202 will be created. All root clusters 202 are clusters of the first level 210 in the hierarchical tree-structure 200 of clusters. Clusters of the first level 210 are clusters of the highest level having no preceding superior level clusters. A root cluster 202 may have one or more immediately following lower level clusters of the second level 220.

The hierarchical tree-structure 200 of clusters can comprises a plurality of internal clusters 204. An internal cluster 204 is the cluster which has one immediately preceding superior level cluster and at least one immediately following lower level cluster. All internal clusters 204 of the second level 220 have, as the immediately preceding superior level cluster, a root cluster 202 of the first level 210. All clusters of the third level 230 have, as the immediately preceding superior level cluster, an internal cluster 204 of the second level 220. All internal clusters 204 of the second level 220 have, as the immediately following lower level cluster, at least one other internal cluster 204 of the third level 230, and/or at least one terminal cluster 206 of the third level 230. Clusters of the second level 220 and lower (such like clusters of the third level 230, fourth level 240 and so on) can be either internal clusters 204 or terminal clusters 206.

Each internal cluster 204 comprises word forms having the same ending as the immediately preceding superior level cluster and also an additional letter. In other words, each internal cluster ("child" cluster) includes an ending that has a portion that is the same as the ending of its "parent" cluster and an additional letter in the ending. For example, cluster 208, being the immediately following lower level cluster of the cluster 202 RC1, can comprise 99 word forms ending with letters "б a", while the cluster 202 RC1 comprises 13927 word forms ending with letter "a".

Each internal cluster of a particular level comprises plurality of word forms, each word form having the same ending, the ending comprising the number of letters being identical to the number of the level of that particular internal cluster. For example, an internal cluster of the third ($3^{rd}$) level 230 comprises word forms having the same ending comprising three (3) letters. An internal cluster of the fourths ($4^{th}$) level 240 comprises word forms having the same ending comprising four (4) letters. The internal cluster of the fourths ($4^{th}$) level 240, being a "child" cluster of the internal cluster of the fourths ($4^{th}$) level 240 (the "parent" cluster), comprises word forms having the same ending of 4 letters. This 4 letters ending comprises a portion of 3 letters being the ending of its "parent" cluster of the $3^{rd}$ level 230, and an additional letter.

The hierarchical tree-structure 200 of clusters can comprise a plurality of terminal clusters 206. A terminal cluster 206 is the cluster having no lower level clusters. In other words, each terminal cluster 206 has no "child" clusters. Like internal clusters 204, each terminal cluster 206 can comprise word forms having the same ending as the immediately preceding superior level cluster (a root cluster 202 or an internal cluster 204 of a respective level), and also an additional letter. Each terminal cluster comprises word forms having both: (i) a same ending being a terminal common ending, and (ii) a same stress position, combination of the terminal common ending, and said same stress position being unique.

Each terminal cluster 206 naturally comprises word forms having the same ending because of method of clustering (the same ending of the immediately preceding superior level cluster and also an additional letter). The following is meant to be an illustration of the meaning of the term "terminal common ending". Let's imagine, for example, that once a particular cluster of the third level 230 is generated, all word forms comprising in that particular cluster of the third level 230 have the same stress position. Let's imagine also, that that particular cluster of the third level 230 comprises word forms which have different fourth, fifths and so on letters, when counted from the end. These different letters can potentially be used for further clustering and creating clusters of the fourth level 240 and lower. However, there is no need in further clustering because the last three letters are sufficient to get a match with a particular stress position. Thus, responsive to all word forms in that particular cluster of the third level 230 have the same stress position, the processor 108 stops clustering word forms using that particular sequence of letters in the endings, and generates the terminal cluster of the third level 230. These three last letters of the word forms comprising in that particular cluster of the third level 230 are the "terminal common ending".

Figure 3:
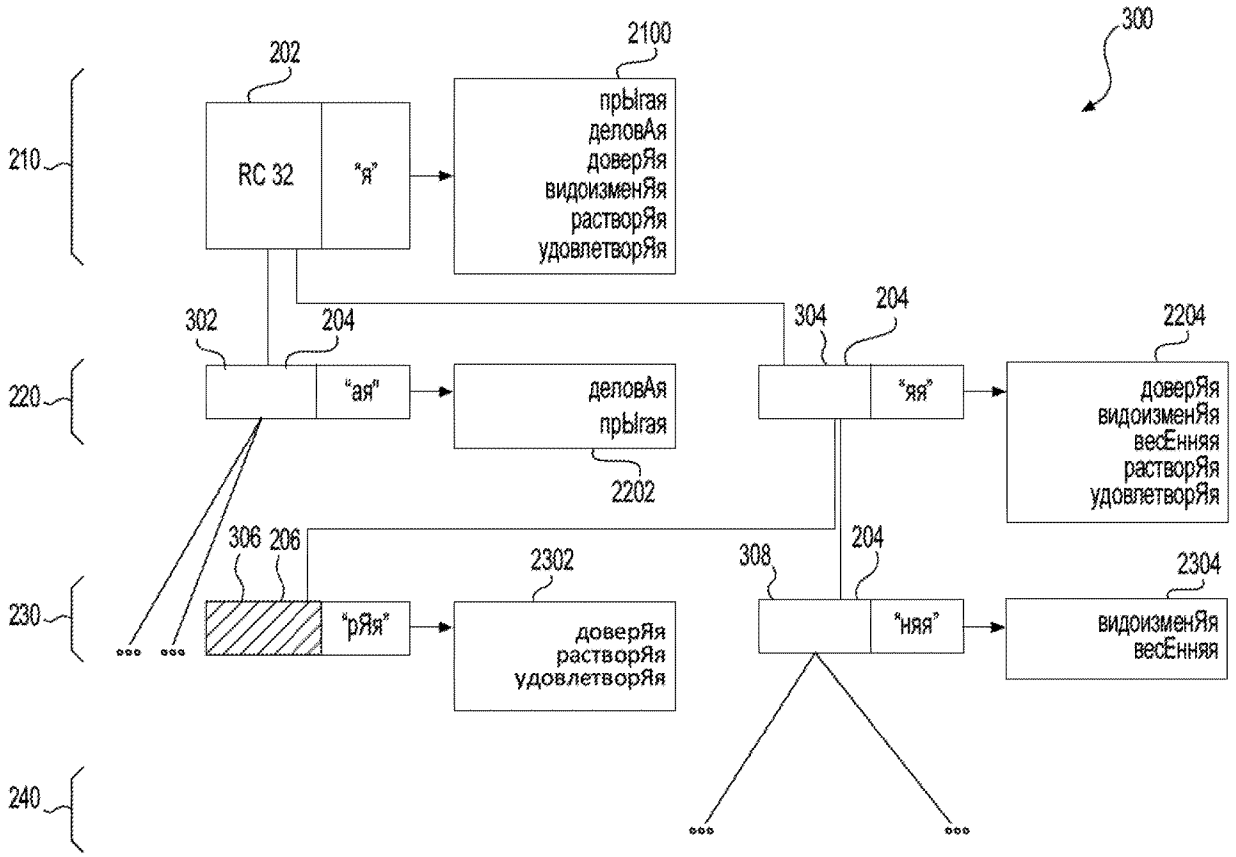
FIG. 3 depicts a fragment of the hierarchical tree-structure of clusters of FIG. 2, the fragment comprising some clusters of: the first level, the second level, and the third level, all being implemented in accordance with non-limiting embodiments of the present technology.

FIG. 3 depicts a fragment 300 of the hierarchical tree-structure 200 of clusters, the fragment 300 comprising some clusters of: the first level 210, the second level 220, and the third level 230. More specifically FIG. 3 depicts one root cluster 202 of the first level 210, being the root cluster 202 RC32, the root cluster 202 RC32 comprising 8820 word forms ending with the last letter of the Russian alphabet "Я". Just six word forms of these 8820 word forms are depicted in a box 2100. All of these word forms end with the letter "Я". Stress position of the word forms depicted in the box 2100 is marked by writing a corresponding stressed vowel with capital letters. Some of these word forms comprising in the box 2100 have a stress position on the second vowel ("Я") from the end of a respective word form, and some of these word forms in the box 2100 have a stress position on the third vowel ("ЫI") from the end of a respective word form. It should be noted that these are just two possible stress position for word form ending with "Я", among several other stress positions in remaining 8814 word forms, not shown in the box 2100 of FIG. 3.

Further, the fragment 300 comprises three intermediate clusters 204 (also numbered 302, 304, and 308): two intermediate clusters 204 (302 and 304) of the second level 220, and one intermediate cluster 204 (308) of the third level 230. The intermediate cluster 204 (302) of the second level 220 comprises word forms, which end with letters "a Я", two of which are depicted in a box 2202. The word forms depicted in the box 2202 have not the same stress position. The second depicted intermediate clusters 204 (304) of the second level 220 comprises word forms, which end with letters "ЯЯ", five of which are depicted in a box 2204. The word forms depicted in the box 2204 have not the same stress position, either.

Both intermediate clusters 302, 304 of the second level 220 are lower level clusters immediately following the root cluster 202 RC32 (the immediately preceding superior level cluster). Both intermediate clusters 302, 304 of the second level 220 also are immediately preceding superior level clusters for immediately following lower level clusters of the third level 230. More specifically, the intermediate cluster 304 of the second level 220 is immediately preceding superior level cluster for the intermediate cluster 308 and for the terminal cluster 206 (306) of the third level 230. The intermediate cluster 308 of the third level has immediately following clusters of the immediately following fourth level 240 (clustered of the fourth level 240 are not depicted).

Further, the fragment 300 comprises one terminal cluster 206 (also numbered 306) of the third level 230 (hashed in FIG. 2 and in FIG. 3). The terminal cluster 306 of the third level 230 comprises word forms, which end with letters "рЯя", three of which are depicted in a box 2302. All word forms comprising in the terminal cluster 306 have the same stress position: at the second vowel from the end. The terminal cluster 306 comprises number of word forms having both: (i) a same ending being a terminal common ending (which is "рЯЯ" in this example), and (ii) a same stress position (which is in this example "рЯя", at the second vowel from the end). Only three word forms of that number of word forms is depicted in the box 2302. The combination of the terminal common ending ("рЯЯ"), and said same stress position ("рЯя", at the second vowel from the end) is unique. Within instant disclosure, the term "unique" means that there is no other terminal cluster having the terminal common ending "рЯя" and the stress position at the second vowel from the end.

In some implementations, the terminal common ending, within any terminal cluster, is an ending of a word forms comprising in an immediately preceding superior level cluster and also an additional letter. For example, as one can see, the word forms depicted in the box 2302 have the same ending being the terminal common ending "ряя". The terminal common ending "ряя" comprises the ending "ЯЯ" of the immediately preceding cluster 304 of the superior second level 220 cluster and an additional letter "р" within the ending.

In some implementations, wherein word forms have the same ending being the terminal common ending, but also have at least two different stress positions, the method further comprises generating at least two corresponding terminal clusters, each of said at least two terminal clusters comprising word forms having: said terminal common ending, and one respective same stress position, and a number of occurrences of said one respective same stress position. In other word forms, word forms in each of these at least two corresponding terminal clusters will have the same terminal common ending, but different stress positions, and also numbers of occurrences of respective stress position.

To make it more clear: word forms having the same ending being the terminal common ending may have two or more different stress positions. For example, Russian word forms "costs" and "stands" are written identically, but they have different stress position: "стОИт" and "стоИт" (respectively the second and the first vowel from the end). Despite the fact that the stress position is different, further clustering, after generating clusters of a fifths level, is not possible, because both word forms have 5 letters only. However, each terminal cluster, as it was explained above, comprises word forms having both: (i) the same ending being the terminal common ending, and (ii) the same stress position. The terminal cluster can not comprise word forms having different stress positions. Since each terminal cluster has to comprise word forms having the same stress position, the processor 108 can generate two terminal clusters having the same terminal common ending, instead of generating one terminal cluster, both of these two terminal clusters comprising word forms having the same terminal common ending ("стоИт"), and each of these two terminal clusters comprising one respective same stress position (respectively "стОИт" or "стоИт"), and a number of occurrences of said one respective same stress position. Both these terminal clusters would be "child" clusters of the immediately preceding cluster of superior level comprising word forms ending with "ТОИТ".

Then, the method 400 proceeds to the step 408.

Step 408—Building, Using the Plurality of Clusters of Word Forms, the Reference System for Determining a Stress Position of a New Word Form Then, at step 408, the processor 108 builds the reference system as an index based on a hierarchical tree structure. The index based on the hierarchical tree structure can mirror the hierarchical cluster structure described earlier. The index has plurality of root nodes. Each root node has child nodes. Each node is a data structure comprising a value. Each non-terminal node (including each root node) comprises value, the value being a combination of letters (or one letter in the case of a root node) together with a list of references to child nodes. The value in each root node can be the same letter as in a respective root cluster 202 of the first level 210. The value in each node of the following level corresponds to the combination of letters in the respective cluster of the second level 220, and so on. Each terminal node comprises data comprising the value, the value being identical to a terminal common ending, together with at least one reference to the at least one terminal cluster 206, the at least one terminal cluster 206 having the same terminal common ending. For example, the terminal node of the hierarchical tree structure can comprise combination of letters "ряя" as a value together with the reference to the terminal cluster 206 (306) which terminal cluster 306 comprises word forms having the terminal common ending "ряя".

Then, the method 400 proceeds to the step 410.

Step 410—Receiving a Request for Defining the Stress Position of the New Word Form At step 410, the processor 108 receives a request for defining the stress position of the new word form. The request can be send by the user 126 from the client device 112 over the communications network 110 to the server 102. The request can be a sentence which user 126 enters, comprising several word forms, including a new word a stress position in which is not stored in the database 106 of the server 102.

Then, the method 400 proceeds to the step 412.

Step 412—Finding, in the Reference System, a Terminal Cluster 206 Comprising Word Forms Having the Same Ending as the New Word Has Then, at step 412, the processor 108, responsive to receiving request for defining the stress position of the new word form, uses a new ending of the new word form for finding, in the reference system for endings, a corresponding terminal cluster having matching terminal common ending.

In this implementation, the using the new ending of the new word form is using a reversed sequence of letters in the new ending of the new word form as a sequence of keys. For example, the server 102 receives from the client device 112 a new word form "проверяя". The processor 108 use the last letter "Я" of the word "проверяя" as a first key, which leads to the root node of the index, which node's value is "Я" together with a list of references to child nodes. Since the root cluster comprises the list of references to child nodes, it is not the terminal cluster. Therefore, the next key is needed to reach the next cluster. The processor 108 uses the second letter from the end, also "Я", of the word "проверяя", as a second key, which leads to the second level node, which node's value is "ЯЯ" together with a list of references to its child nodes. Since this cluster of the second level comprises the list of references to its child nodes, it is not the terminal cluster, either. Therefore, the next key is needed to reach the next cluster. The processor 108 uses the third letter from the end, the letter "р", of the word "проверяя", as a third key, which leads to the third level node. The third level node's value is "ряя" together with one reference the terminal cluster 306, the terminal cluster 306 having the same terminal common ending "ряя".

In alternative implementations of the present technology, the computer-readable instructions, stored on the information storage medium 104, when executed, can cause the processor 108 to use a "brute force" method trying all possible endings of the new word in order to find a corresponding terminal cluster. For example, the processor 108 can use as keys following eight endings of the word form "проверяя": 1) "Я"; 2) "ЯЯ"; 3) "ряя"; 4) "еряя"; 5) "верряя"; 6) "оверряя"; 7) "роверЯЯ", 8) "проверяя". The processor 108 will detect that the third ending, "ряя", correspond to a terminal cluster, while all other endings do not correspond to any terminal cluster.

Then, the method 400 proceeds to the step 414.

Step 414—Applying to the New Word Form that Stress Position Which Corresponds to a Stress Position of Word Forms Being Included into the Corresponding Terminal Cluster 306

Then, at step 414, the processor 108 applies to the new word form that stress position which corresponds to a stress position of word forms being included into the corresponding terminal cluster. For example, the stress position of word forms being included into the corresponding terminal cluster 306 is on the second vowel from the end of the word form. Therefore, the processor 108 will apply that stress position to the new word "проверяя" (the stress position: "проверЯя"). Thereafter, the server 102 can send over the communication network 110 instructions to the client device 112 (or a sentence comprising the new word) thereby causing the client device 126 to generate a spoken utterance of the so-entered word forms and/or sentences and to produce the correct spoken utterance using the loudspeaker 124.

The method 400 then ends.

A specific technical effect attributable to at least some embodiments of the present technology include saving computational resources of computing devices for calculating stress position in a new word during real-time processing.

Modifications and improvements to the above-described implementations of the present technology may become apparent to those skilled in the art. The foregoing description is intended to be exemplary rather than limiting. The scope of the present technology is therefore intended to be limited solely by the scope of the appended claims.

The invention claimed is:

1. A method for building a reference system for determining, by a computing device, a stress position of a new word form, the method comprising:

sorting, in a reverse lexicographic order, a plurality of word forms, each word form of the plurality of word forms being marked with a particular stress position, in order to generate a plurality of sorted word forms, clustering the plurality of sorted word forms into a plurality of clusters of word forms such that the plurality of clusters of word forms comprises a plurality of terminal clusters, each terminal cluster of the plurality of terminal clusters comprising word forms having both: (i) a same ending being a terminal common ending, and (ii) a same stress position, a combination of the terminal common ending and said same stress position being unique;

building, using the plurality of terminal clusters, the reference system for determining the stress position of the new word form, the reference system having a reference to at least one terminal cluster of the plurality of terminal clusters, the at least one terminal cluster comprising an indication of the particular stress position proper to word forms which are included in that respective terminal cluster.

2. The method of claim 1, wherein the terminal common ending, within any terminal cluster, is an ending of a word forms comprising in an immediately preceding superior level cluster and also an additional letter.

3. The method of claim 1, wherein clustering the plurality of sorted word forms into a plurality of clusters of word forms further comprises organizing the plurality of clusters into a hierarchical tree-structure of clusters, the organizing being performed such that:

(i) the plurality of clusters of word forms comprises:

(a) a plurality of root clusters, each root cluster having at least one immediately following lower level cluster, and (b) the plurality of terminal clusters, each terminal cluster of the plurality of terminal clusters having no lower level cluster;

(ii) at least some clusters of the hierarchical tree-structure, in respect to each other, are immediately preceding superior level clusters and immediately following lower level clusters, and (iii) an ending of a word form in a immediately following lower level cluster has a same sequence of letters as in a immediately preceding superior level cluster and also an additional letter.

4. The method of claim 3, wherein the hierarchical tree-structure of clusters further comprises a plurality of internal clusters, each internal cluster being the immediately following lower level cluster of an immediately preceding superior level cluster and the immediately preceding superior level cluster in respect to at least one immediately following lower level cluster.

5. The method of claim 1 wherein word forms, the word forms having the same ending being the terminal common ending, have at least two different stress positions, the method further comprises generating at least two terminal clusters, each of said at least two terminal clusters comprising word forms having:

said terminal common ending, and one respective same stress position, and a number of occurrences of said one respective same stress position.

6. The method of claim 5, further comprising receiving a request for defining the stress position of the new word form and, responsive to receiving said request:

using a new ending of the new word form for finding, in the reference system for endings, said at least two terminal clusters, and applying to the new word form that stress position which corresponds to a stress position of word forms being in that one of said at least two terminal clusters, which terminal cluster has a highest number of occurrences of a particular stress position.

7. The method of claim 1, further comprising, before the sorting the plurality of word forms, acquiring, from a supplying device, the plurality of word forms.

8. The method of claim 7, wherein the acquiring the plurality of word forms comprises acquiring at least one word form of the plurality of word forms being marked with the particular stress position.

9. The method of claim 7, wherein the acquiring the plurality of word forms is acquiring from at least one literature source.

10. The method of claim 1, wherein word forms are word forms of a particular language.

11. The method of claim 10, wherein word forms are Russian-language word forms.

12. The method of claim 1, further comprising receiving a request for defining the stress position of the new word form and, responsive to receiving said request:

using a new ending of the new word form for finding, in the reference system for endings, a corresponding terminal cluster having matching terminal common ending, and applying to the new word form that stress position which corresponds to a stress position of word forms being included into the corresponding terminal cluster.

13. The method of claim 12, wherein the using the new ending of the new word form is any one, selected from: (i) using the new ending of the new word form as a key, and (ii) using a reversed sequence of letters in the new ending of the new word form as a sequence of keys.

14. A computing device for building a reference system for determining a stress position of a new word form, the computing device comprising a processor and an information storage medium storing computer-readable instructions that, when executed by the processor, cause the processor to perform:

sorting, in a reverse lexicographic order, a plurality of word forms, each word form of the plurality of word forms being marked with a particular stress position, in order to generate a plurality of sorted word forms, clustering the plurality of sorted word forms into a plurality of clusters of word forms such that the plurality of clusters of word forms comprises a plurality of terminal clusters, each terminal cluster of the plurality of terminal clusters comprising word forms having both: (i) a same ending being a terminal common ending, and (ii) a same stress position, a combination of the terminal common ending and said same stress position being unique;

building, using the plurality of terminal clusters, the reference system for determining the stress position of the new word form, the reference system having a reference to at least one terminal cluster of the plurality of terminal clusters, the at least one terminal cluster comprising an indication of the particular stress position proper to word forms which are included in that respective terminal cluster.

15. The computing device of claim 14, wherein the terminal common ending, within any terminal cluster, is an ending of a word forms comprising in an immediately preceding superior level cluster and also an additional letter.

16. The computing device of claim 14, wherein clustering the plurality of sorted word forms into a plurality of clusters of word forms further comprises organizing the plurality of clusters into a hierarchical tree-structure of clusters, the organizing being performed by the processor such that:

(i) the plurality of clusters of word forms comprises:

(a) a plurality of root clusters, each root cluster having at least one immediately following lower level cluster, and (b) the plurality of terminal clusters, each terminal cluster of the plurality of terminal clusters having no lower level cluster;

(ii) at least some clusters of the hierarchical tree-structure, in respect to each other, are immediately preceding superior level clusters and immediately following lower level clusters, and (iii) an ending of a word form in a immediately following lower level cluster has a same sequence of letters as in a immediately preceding superior level cluster and also an additional letter.

17. The computing device of claim 16, wherein the hierarchical tree-structure of clusters further comprises a plurality of internal clusters, each internal cluster being the immediately following lower level cluster of an immediately preceding superior level cluster and the immediately preceding superior level cluster in respect to at least one immediately following lower level cluster.

18. The computing device of claim 14 wherein word forms, the word forms having the same ending being the terminal common ending, have at least two different stress positions, and wherein the computer-readable instructions, when executed by the processor, further cause the processor to generate at least two terminal clusters, each of said at least two terminal clusters comprising word forms having:

said terminal common ending, and one respective same stress position, and a number of occurrences of said one respective same stress position.

19. The computing device of claim 18, wherein the computer-readable instructions, when executed by the processor, further cause the processor to receive a request for defining the stress position of the new word form and, responsive to receiving said request:

to use a new ending of the new word form for finding, in the reference system for endings, said at least two terminal clusters, and to apply to the new word form that stress position which corresponds to a stress position of word forms being in that one of said at least two terminal clusters, which terminal cluster has a highest number of occurrences of a particular stress position.

20. The computing device of claim 14, wherein the computer-readable instructions, when executed by the processor, further cause the processor to receive a request for defining the stress position of the new word form and, responsive to receiving said request:

to use a new ending of the new word form for finding, in the reference system for endings, a corresponding terminal cluster having matching terminal common ending, and to apply to the new word form that stress position which corresponds to a stress position of word forms being included into the corresponding terminal cluster.

* * * * *